United States Patent [19]

Burdick

[11] 3,951,258

[45] Apr. 20, 1976

[54] MATCH BOOK SAFETY CASE

[76] Inventor: Herbert L. Burdick, 4312 - 17th St., Racine, Wis. 53405

[22] Filed: Sept. 8, 1975

[21] Appl. No.: 611,341

[52] U.S. Cl. ..... 206/107; 206/108; 206/118

[51] Int. Cl.[2] ..... A24F 27/04

[58] Field of Search ..... 206/90, 91, 92, 94, 206/106, 107, 108, 110, 111, 112, 113, 114, 118

[56] References Cited

UNITED STATES PATENTS

| | | | |
|---|---|---|---|
| 1,471,912 | 10/1923 | Oppenheim | 206/107 |
| 2,116,231 | 5/1938 | Beyer | 206/106 |
| 2,283,709 | 5/1942 | Van Ness | 206/106 |
| 2,309,965 | 2/1943 | Lee | 206/107 |
| 2,391,856 | 2/1944 | Comee | 206/118 |
| 2,427,367 | 9/1947 | Patten | 206/107 |
| 2,542,339 | 2/1951 | Loether | 206/110 |
| 3,871,517 | 3/1975 | Cioffi | 206/108 |

*Primary Examiner*—William Price
*Assistant Examiner*—Bruce H. Bernstein
*Attorney, Agent, or Firm*—Arthur J. Hansmann

[57] ABSTRACT

A match book safety case having a back and a front hinged together for enclosing a book of matches. The case presents an opening so that the striker portion of the book itself is exposed when the case is closed; and the case has a safety device which automatically covers the book striker portion when the cover is open, and therefore the user cannot strike a match until the cover is closed.

5 Claims, 11 Drawing Figures

MATCH BOOK SAFETY CASE

This invention relates to a match book safety case, and, more particularly, it relates to a match book safety case which has a cover which must be closed in order to have the book striker portion exposed and available for use.

BACKGROUND OF THE INVENTION

Match book cases are already known in the prior art, and they exist in many different forms which are useful in receiving and enclosing a regular book of matches, and these cases may be made of metal or plastic or any suitable material for enclosing the standard book of matches. With the use of a match book case, the regular match book, being made of a cardboard or paper material of well-known construction, is protected from crushing and moisture and is also protective of the matches themselves and preserves them for their normal use. Still further, it is well known that the usual match book is arranged and provided to have a safety feature, namely, that the book cover should be closed before the matches are struck against the striker portion of the match book, and thus the other matches will not be ignited by a spark. However, it is common practice and generally known that users do not close the cover of the conventional match book before striking a match, and thus there is a fire hazard in the normal use of a match book. Further, match book metal or plastic cases, such as those mentioned above, do not solve the problem of the fire hazard, since the prior art match book cases have no safety arrangement which is sufficiently usable and reliable.

Examples of prior art match book cases are found in U.S. Pat. Nos. 749,539 and 1,432,473 and 1,471,331 and 2,356,926 and 2,556,817 and 2,653,750. The aforementioned prior art patents are not concerned with the safety and the use of the matches, and they simply provide a means for enclosing the match book and protecting it against crushing or the like. One prior art patent, namely, U.S. Pat. No. 2,700,455 also discloses a match book case or holder, and that patent does mention the safety feature. However, that patent is not truly a case arranged with a safety device, and the user can easily obviate the safety device by simply holding the cover open and against a spring which is intended to close the cover when striking the match.

Accordingly, it is an object of this invention to provide a match book safety case which is reliable and is arranged so that it can not be circumvented or obviated by the user who must therefore use the case in its safe manner before striking a match. As such, the present invention provides a match book safety case which is an improvement upon those heretofore known in the prior art.

Still further, it is an object of this invention to provide a match book safety case which is readily and easily provided and is therefore not expensive and complicated, and which compactly retains the matches therein and which assures that the user must use the case in its intended safe manner before a match can be struck.

Still further, it is an object of this invention to provide a match book safety case which accomplishes the aforementioned objectives and which accommodates a match book having a striker on both the front and back thereof, and, in both instances, the case of this invention provides the desired element of safety even though the match book contained therein may have its striker on either the front or the rear thereof or even on both sides thereof.

Other objects and advantages will become apparent upon reading the following description in light of the accompanying drawings.

BRIEF DESCRIPTION OF THE DRAWINGS

FIG. 1 is a front elevational view of a match book case of this invention.

DETAILED DESCRIPTION OF THE PREFERRED EMBODIMENT

Figures 2, 3, 4, 5, 6, 7, 8, 9, 10, 11:
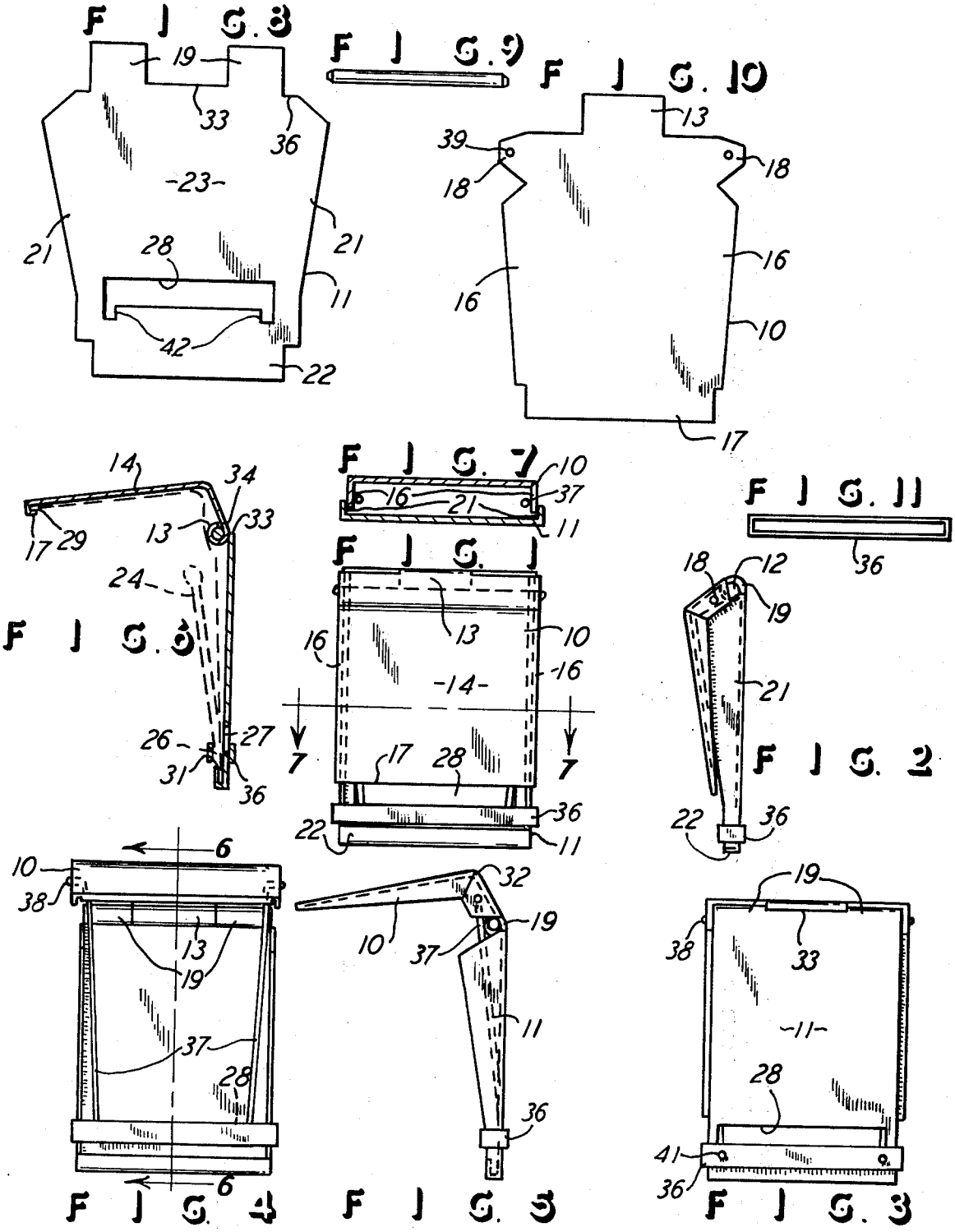
FIGS. 2 and 3 are side and rear elevational views, respectively, of FIG. 1.
FIG. 4 is a front elevational view of the case of FIG. 1 but with the front piece in the upward or open position.
FIG. 5 is a side elevational view of FIG. 4.
FIG. 6 is a sectional view taken on the line 6—6 of FIG. 4.
FIG. 7 is a sectional view taken on the line 7—7 of FIG. 1.
FIGS. 8, 9, 10, and 11, are elevational views of the back piece, pin, front piece, and safety belt, respectively, prior to assembly and being parts included in the aforementioned views.

The drawings show the embodiment of this match book case which is constructed of a front piece 10, a back piece 11, a pin 12, and a belt 15, all of which are seen in FIGS. 1, 2, and 3 in their assembled form and with the case in the closed position. The front piece 10 is shown to have one rolled-over edge 13 which extends in one direction from the plane of the piece body designated 14, and that front piece 10 also has two side inturned edges 16 which extend in the same direction as the extent of the rolled-over edge 13. Further, the front piece 10 has an in-turned edge 17, and this edge is best seen in FIG. 6, and it too extends to the same side of the body 14 as the extent of the rolled-over edge 13 and the in-turned side 16.

That is, FIG. 10 shows the front piece 10 prior to its final formation, and in the condition of FIG. 10 it is a flat piece preferably of metal and has the face configuration as seen in FIG. 10 wherein the rolled-over edge 13, in-turned sides 16, and upturned end or edge 17 are all shown prior to their final configuration. Also, the cover piece 10 has the side tabs 18 which are part of the in-turned sides 16 for purposes of this description.

The back piece 11 is similarly provided and formed, and it is shown in FIG. 8 in its position prior to final configuration, and the drawings further show that the back piece 11 has two rolled-over edges 19, and it has the in-turned opposite sides 21, and it also has the up-turned edge 22. FIG. 8 shows these various portions prior to their final configuration as seen in the other views. Further, it will be understood that the back piece 11 is initially made of a flat sheet, preferably of metal, and the front piece and back piece as shown in FIGS. 10 and 8, respectively, can be made of simple stampings, and the rolled-over edges, the in-turned opposite sides, and the up-turned edges, all as described on the respective said two pieces, can be readily formed and all extend to the same side of the main body or planar portion of each piece, such as the portion 14 of the front piece 10 and the portion 23 of the back piece 11. This arrangement and configuration permits the pieces to be readily formed and to be disposed in a compact relationship when in the closed position shown in FIGS. 1, 2, and 3. Further, the in-turned sides of the respective pieces 10 and 11 overlap each other, as clearly shown in FIG. 7, and thus the pieces are held in the closed position by frictional overlap, and the case is thus a tight case which protects the enclosed book of matches, such as the book indicated by dotted lines 23 in FIG. 6, from wear and tear and from the dirt and moisture elements.

FIGS. 1 and 2 particularly further show that the front cover 10 has its upturned edge 17 disposed spaced from the back piece up-turned edge 22, and thus the striker material on the match book, such as that which would be indicated at 26 in FIG. 6, exposed when the cover 10 is in the closed position and thus the match can be struck against the striker material 26 and the closed position of the case provides the safety purpose. Still further, match book cases today are commonly made with a striker material at the rear of the match book, such as at the location designated 27 in FIG. 6. For this instance, the back piece 11 is provided with a rectangularly-shaped opening 28 which aligns with and thus exposes the striker surface 27 of the match book 24. With this arrangement of the case, a match book made with the striker material 26 or 27 will be exposed and therefore either striker surface 26 or 27 can be used with the cover 10 in the closed position.

It will further be seen and understood that each piece 10 and 11 has the in-turned edge portion 17 and 22, respectively, and these portions present pockets, respectively 29 and 31, and these pockets receive the respective ends of the match book case 24. Further, the in-turned sides 21 of the back piece 11 are enlarged toward the joined hinged ends adjacent the pin 12, and the cover 10 also has its offset portion designated 32, such that the enlarged sides 21 and the offset portion 32 provide room for the head portion of the match book case.

The cover tabs 18 are placed in their final angulated or bent form as seen in FIG. 2, for instance, and after the pin 12 is in assembled position, so that the tabs 18 are disposed to overlap the ends of the pin 12 so that the pin cannot slide out of the confinement by the rolled-over edges. In this manner, the case is made in a simplified form but yet is secure and the tabs 18 hold the pin 12 in position. Further, the back piece 11 is shown to have a portion 33 extending between its two rolled-over edges 19 and projecting into a position where the portion 33 abuts the tangential portion designated 34 on the top cover 10 such that the top cover 10 is limited in its opening hinge action, such as seen in FIG. 6. That is, the portion 33 serves as a stop for abutting the cover portion 34 and preventing further upward hinged movement of the cover 10 beyond that position shown in FIG. 6. With this arrangement, the hinge cannot be abused by excessive hinge action, and the case pockets 29 and 31 will be able to retain the respective ends of the match book without being removed from the pockets 29 and 31 because of the limited hinge action described.

FIG. 8 shows that the back piece 11 has its rolled-over portions 19 on opposite sides of the portion 33 whose edge extends higher than the edge designated 36, and thus the edge 33 extends upwardly and toward the top portion 34 for providing the stop, as described. That is, the stop or edge 33 actually extends up to the height of the pin 12 which is located by the position of the rolled-over edges 19, and that position is significant for providing the stop 33 relative to the top portion 34. That is, the rolled-over edges 19 extend half above and half below the horizontal plane of the edge 33, and thus the pin 12 is disposed axially on that plane and therefore the edge 33 serves as a stop in the position shown in FIG. 6, for the desired purposes mentioned.

It will therefore be noticed that the back piece 11 has the rectangularly-shaped opening 28 for exposing the match book striker 27 at the rear of the case; and, also, the case front cover 10 extends to its edge 17 which, in the closed position of FIG. 1, is clear or short of the match book front striker portion 26. Thus, in the closed position of the case, the match book front and/or rear strikers 26 and/or 27 are exposed and available for use. However, when the cover 10 is in the open or raised position, as shown in FIGS. 4, 5, and 6, then a safety belt 36 extends over the match book striker portions 26 and 27, as shown in those three views. Therefore, only when the cover 10 is in the closed position or the striker portions 26 and 27 exposed for use, and thus there is a safety element in the match book case of this invention. The belt 36 is shown to be a rectangular shape in FIG. 11 and it extends endlessly around the lower end of the case and slides up and down thereon between the position of covering the striker portions 26 and 27, and that means that it extends over the opening 28 when the cover 10 is in the raised position, and the belt 36 slides downwardly to expose the opening 28 and the front striker portion 26, when the cover 10 is in the lowered or closed position. The member 36 thus moves up and down on the back portion 11 as described and shown in the drawings, and the member 36 moves in direct response to and in proportion to the hinged or pivotal movement of the cover 10. That is, two wires 37 are connected at their upper ends 38 to the cover portions 18 by extending through the circular openings 39 in the cover 10, and the wires are bent at their upper ends 38 and extend downwardly inside the case side walls 21 and are suitably attached to the belt member 36, such as extending therethrough in the wire lower ends 51, as seen in FIG. 3. Thus, the wires 37 act as links between the cover 10 and the member 36, for the up and down sliding movement of the member 36, as shown and described. Of course the wires 37 are arranged so that they do not interfere with the book of matches held in the case, and therefore the wires are of a small gauge and extend adjacent the in-turned edges 21, and the wire lower ends 41 align with notches 42 in the rear portion 11 to thus permit the wires to maintain connection with the member 36 even when the member 36 is in its fully lowered position which is when the cover 10 is closed.

With this arrangement, the user must close the cover 10 before he can strike a match, since the match book striker portions 26 and 27 are concealed and covered over by the member 36 when the cover 10 is in the opened position, and, conversely, the striker portions 26 and 27 are exposed when the cover is in the closed position and the member 36 has then been slid downwardly to where the match can be struck against either portion 26 or 27. As such, the match book case of this invention provides a safety feature, and the case is of a simplified but yet reliable and sturdy construction and the user is compelled to close the cover 10 before the match can be struck, and thus the user cannot obviate the safety feature.

What is claimed is:

1. A match book safety case comprising a back piece and a front piece hingedly connected together for opening and closing said front piece relative to said back piece and with said pieces being arranged for retaining a match book which has a match striker surface thereon, a member movably disposed relative to said pieces and being movable to a position to cover the striker surface, and a connector attached between said front piece and said member to connect said member to said front piece and for moving said member in response to hinged movement of said front piece for covering the striker surface when said front piece is hingedly moved away from said back piece and thereby prevent use of the striker surface when said pieces are in the open position.

2. The match book safety case as claimed in claim 1, wherein said member is an endless belt slidably extending around said back piece.

3. The match book safety case as claimed in claim 1, including two said connectors and which are wires hooked onto said front piece and onto said member.

4. The match book safety case as claimed in claim 1, wherein said back piece has an opening therein for the exposure of the striker surface through said opening, and said member being of a size sufficient to cover said opening in preventing the use of said striker surface.

5. The match book safety case as claimed in claim 1, wherein said back piece is of a length greater than that of said front piece to have an end portion extend beyond said front piece for exposure of the striker surface when said front piece is closed relative to said back piece, and said member extending across the extended said end portion of said back piece for covering the striker surface when said front piece is open relative to said back piece.

* * * * *